US011883928B2

(12) United States Patent
Zhang et al.

(10) Patent No.: US 11,883,928 B2
(45) Date of Patent: Jan. 30, 2024

(54) POLISHING MECHANISM, POLISHING DEVICE, AND POLISHING METHOD

(71) Applicant: Fulian Yuzhan Precision Technology Co., Ltd, Shenzhen (CN)

(72) Inventors: Feng Zhang, Shenzhen (CN); Ming Luo, Shenzhen (CN); Ai-Jun Tang, Shenzhen (CN); Jian-Jun Meng, Shenzhen (CN)

(73) Assignee: Fulian Yuzhan Precision Technology Co., Ltd, Shenzhen (CN)

( * ) Notice: Subject to any disclaimer, the term of this patent is extended or adjusted under 35 U.S.C. 154(b) by 332 days.

(21) Appl. No.: 17/322,247

(22) Filed: May 17, 2021

(65) Prior Publication Data

US 2021/0362284 A1 Nov. 25, 2021

(30) Foreign Application Priority Data

May 20, 2020 (CN) ..... 202010432155.8

(51) Int. Cl.
*B24B 9/00* (2006.01)
*B24B 51/00* (2006.01)

(52) U.S. Cl.
CPC ..... *B24B 9/00* (2013.01); *B24B 51/00* (2013.01)

(58) Field of Classification Search
CPC ..... B24B 9/00; B24B 51/00; B24B 19/00; B24B 23/00; B24B 37/00; B24B 37/34; H02K 7/145
See application file for complete search history.

(56) References Cited

U.S. PATENT DOCUMENTS

| | | | | |
|---|---|---|---|---|
| 6,863,598 | B2 * | 3/2005 | Ling | B24B 19/226 451/163 |
| 7,438,629 | B2 * | 10/2008 | Bosten | B24B 55/105 451/28 |
| 7,976,361 | B2 * | 7/2011 | Takahashi | B24B 21/002 451/303 |
| 8,133,092 | B2 * | 3/2012 | Arcona | B24B 23/00 451/357 |
| 9,211,627 | B2 * | 12/2015 | Andou | B24B 19/226 |
| 9,266,211 | B2 * | 2/2016 | Yoshihara | B24B 9/04 |
| 11,554,459 | B2 * | 1/2023 | Wu | H02K 5/1732 |
| 2013/0109277 | A1 * | 5/2013 | Panergo | B24B 19/26 901/41 |

FOREIGN PATENT DOCUMENTS

| | | | |
|---|---|---|---|
| CN | 2219770 | Y | 2/1996 |
| CN | 101664896 | A | 3/2010 |
| CN | 104669114 | A | 6/2015 |
| CN | 205950471 | U | 2/2017 |
| CN | 206717594 | U | 12/2017 |

* cited by examiner

*Primary Examiner* — David B. Thomas
(74) *Attorney, Agent, or Firm* — ScienBiziP, P.C.

(57) ABSTRACT

A mechanism for polishing includes a polishing member, an eccentric member coupled to the polishing member, and a driving member coupled to the eccentric member. The driving member drives the eccentric member to rotate to move the polishing member to reciprocate in the one-dimensional direction, so that when a relative position between the polishing mechanism and the workpiece is fixed, the polishing member polishes a workpiece by translating a polishing surface. A method for the polishing process, applied by a polishing device, is also disclosed. By using the polishing mechanism, the entirety of the polishable surface of the workpiece can be covered, and collapsed edges of the workpiece are avoided.

18 Claims, 10 Drawing Sheets relevant art

POLISHING MECHANISM, POLISHING DEVICE, AND POLISHING METHOD

CROSS-REFERENCE TO RELATED APPLICATIONS

This application claims priority to Chinese Patent Application No. 202010432155.8 filed on May 20, 2020, the contents of which are incorporated by reference herein.

FIELD

The subject matter herein generally relates to manufacturing processes, and particularly to a polishing mechanism, a polishing device, and a polishing method.

BACKGROUND

In the field of manufacturing and processing, some workpieces need to be polished by a polishing device, so that a surface accuracy of the workpiece can meet the predetermined requirements.

In some polishers, such as a pneumatic polisher, a polishing member of the polisher rotates and polishes during a polishing process. As shown in FIG. 1, a polishing mechanism 1 is moved to drive the polishing member 2 to repeatedly polish a workpiece 4. When a relative position between the polishing mechanism 1 and the workpiece 4 is fixed, a relative position between the polishing member 2 and a polishing surface 3 of the workpiece 4 is also fixed. However, due to a vibration caused by a high-speed rotation of the polishing member 2 itself, the polishing surface 3 can shift in the X and Y directions, which may cause an edge of the workpiece 4 to collapse or break off during the polishing process.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Implementations of the disclosure will now be described, by way of embodiments only, with reference to the drawings. The disclosure is illustrative only, and changes may be made in the detail within the principles of the present disclosure. It will, therefore, be appreciated that the embodiments may be modified within the scope of the claims.

Unless otherwise defined, all technical terms used herein have the same meaning as commonly understood by one of ordinary skill in the art. The technical terms used herein are to provide a thorough understanding of the embodiments described herein but are not to be considered as limiting the scope of the embodiments.

Several definitions that apply throughout this disclosure will now be presented.

The term "coupled" is defined as connected, whether directly or indirectly through intervening components, and is not necessarily limited to physical connections. The term "substantially" is defined to be essentially conforming to the particular dimension, shape or other word that the term modifies, such that the component need not be exact. The term "comprising," when utilized, means "including, but not necessarily limited to"; it specifically indicates open-ended inclusion or membership in the so-described combination, group, series and the like.

Figure 1:
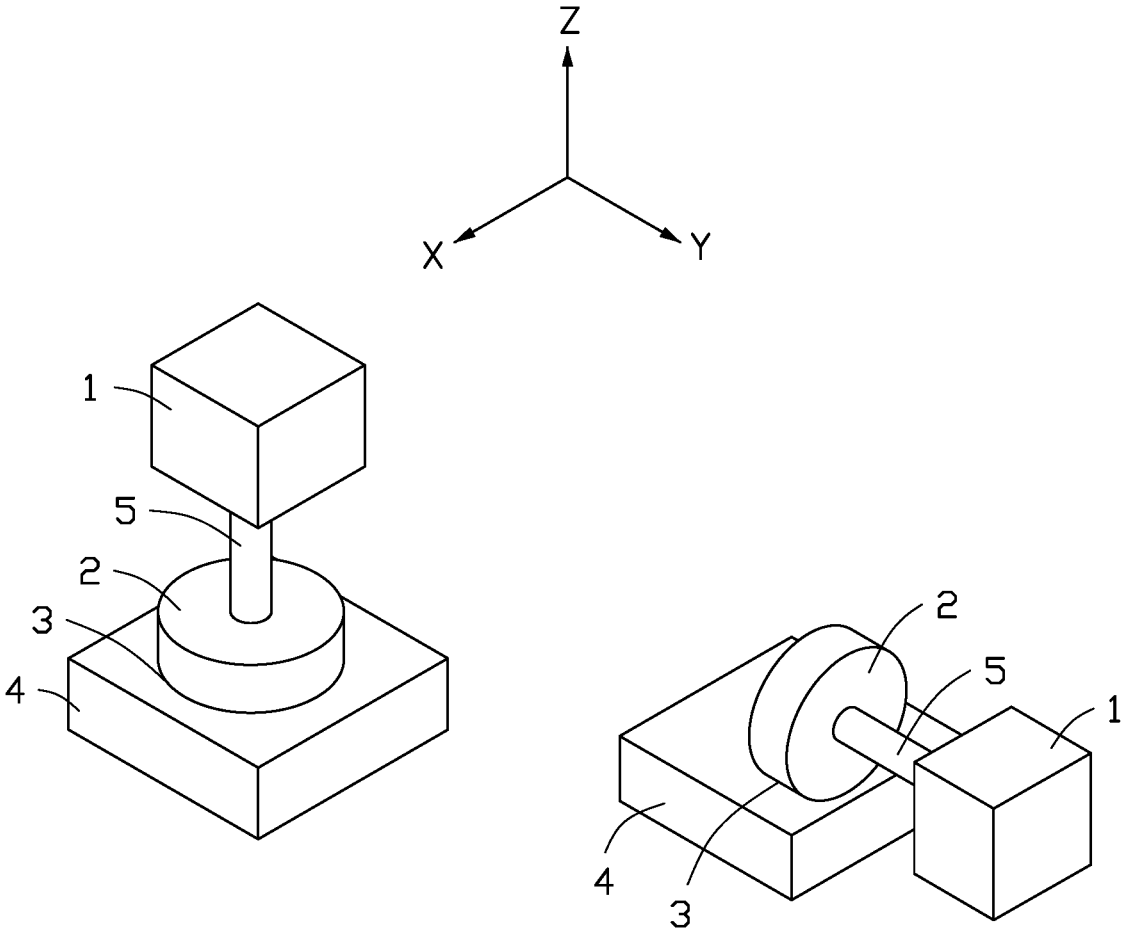
FIG. 1 illustrates a diagrammatic view of polishing mechanism with a workpiece in the relevant art.

In an existing polishing machine, a relative position between a polishing member and the polishing machine is fixed, and the polishing member repeatedly polishes a fixed polishing surface of a workpiece by its own rotation, such the polishing method is defined as a manner of fixing a polishing surface, as shown in FIG. 1. In the manner of fixing a polishing surface, a relation position between the polishing member and the polishing surface of the workpiece is fixed when the polishing member rotates to polish the workpiece. In such polishing method, the accuracy and efficiency of polishing depends entirely on a stable control of the polishing mechanism 1 regarding a position of the polishing member 2 (for example, accuracy should be high enough even when the polishing member 2 is moved), a rotating speed of the polishing member 2 itself, a size of the polishing surface 3, etc. When in use, due to vibration, an edge of the workpiece 4 may collapse when the workpiece 4 is polished by the manner of fixing a polishing surface, and some surfaces of the workpiece 4 may be not polished accurately (for example, insufficient flatness after being polished).

Figure 2:
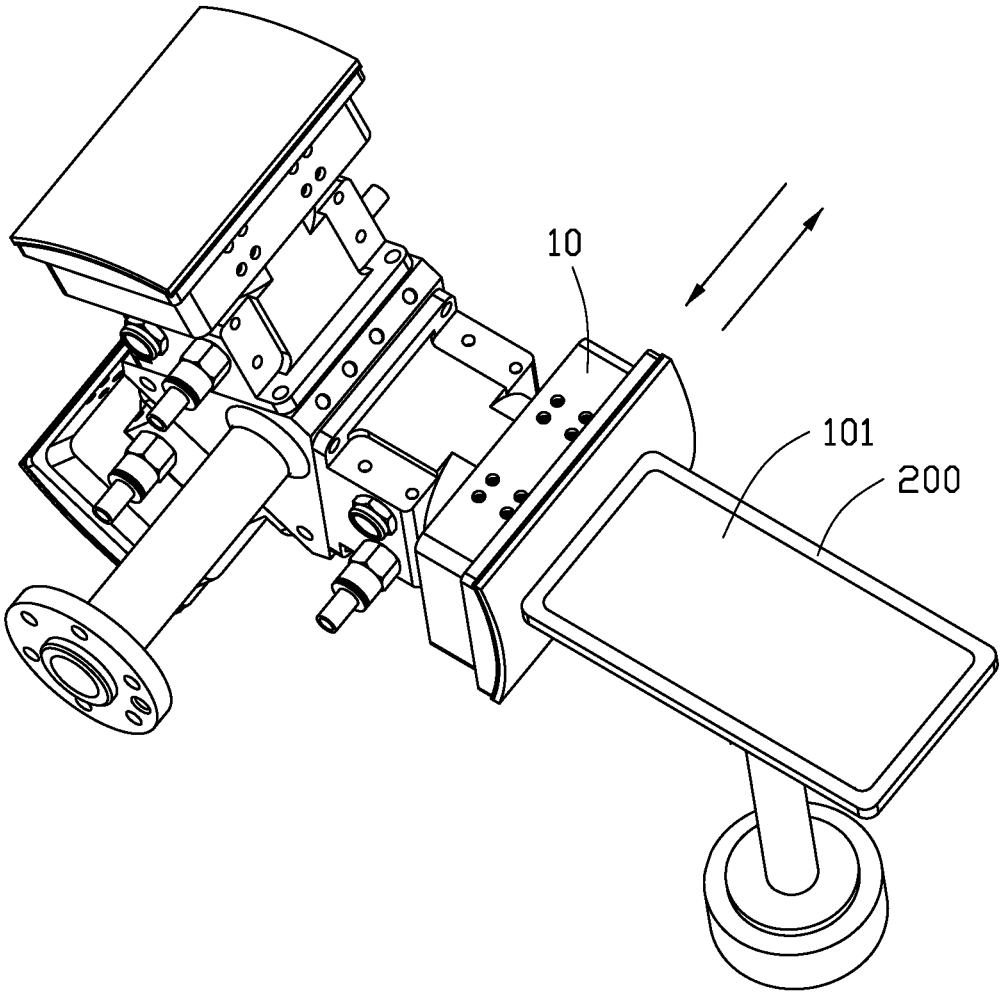
FIG. 2 illustrates an isometric view of an embodiment of a polishing mechanism with a workpiece.

FIG. 2 illustrates an embodiment of a polishing mechanism 10, which is configured to polish a workpiece 200. For example, the workpiece 200 is substantially frame shaped and is sleeved on a positioning fixture 101, the polishing mechanism 10 is disposed adjacent to a side of the workpiece 200.

Figure 3:
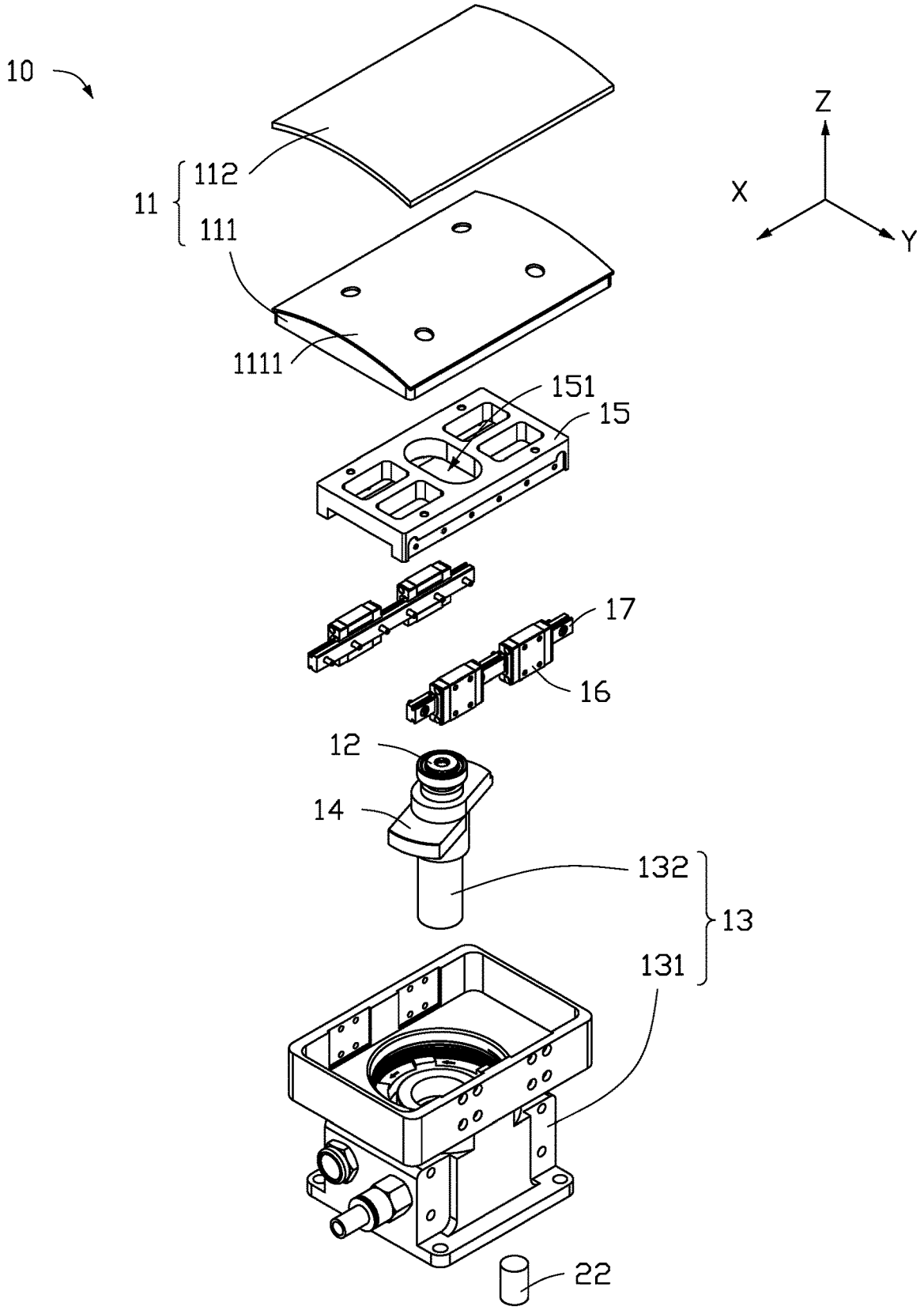
FIG. 3 illustrates an isometric exploded view of an embodiment of a polishing mechanism.

Referring to FIG. 3, in one embodiment, the polishing mechanism 10 includes a polishing member 11, an eccentric member 12, and a driving member 13.

The polishing member 11 is configured to polish the workpiece 200. The eccentric member 12 is coupled to the polishing member 11. The driving member 13 is coupled to the eccentric member 12. The driving member 13 is configured to drive the eccentric member 12 to rotate, to drive the polishing member 11 to reciprocate in one-dimensional direction, so that when the relative position of the polishing mechanism 10 and the workpiece 200 are fixed, the polishing member 11 polishes the workpiece 200 by translating a polishing surface.

It is to be noted, the one-dimensional direction mentioned refers to the X-axis direction in one embodiment. The term "the manner of translating a polishing surface" is defined relative to the term "the manner of fixing a polishing surface". In the manner of translating a polishing surface, a relative position between the polishing mechanism 10 and the polishing member 11 is fixed, but the polishing mechanism 10 and the polishing member 11 can move relative to each other in laterally (that is the one-dimensional direction) when the polishing member 11 rotates to polish the workpiece 200. In the manner of translating a polishing surface, the polishing member 11 makes contact with the workpiece 200 by an overpressure manner to form a semi-cylindrical side surface which acts as a polishing surface, so that when the relative positions between the polishing mechanism 10 and the workpiece 200 are fixed, the polishing surface is translated with a relative movement of the polishing member 11 and the workpiece 200.

The polishing member 11 includes a support member 111 and a polishing portion 112.

The support member 111 is substantially plate-shaped. The support member 111 includes an arc surface 1111.

The polishing portion 112 is arranged on the arc surface 1111 and is configured to polish the workpiece 200. A polishing width of the polishing portion 112 in the one-dimensional direction is smaller than a width of a polishable surface of the workpiece 200. If the polishing portion 112 is a sandpaper, the sandpaper can be attached to the arc surface 1111 with Velcro for example.

When the workpiece 200 is being polished, the arc surface 1111 of the polishing portion 112 is in contact with the workpiece 200 directly, so that the contact area between the polishing portion 112 and the workpiece 200 is small, and the arc surface 1111 tends to be in line contact with the workpiece 200. Therefore, during polishing, there will be no problems of collapsed edges caused by the contact area being too large or over polished, thereby improving the precision of polishing.

The eccentric member 12 is an eccentric shaft. The eccentric member 12 is coupled to the support member 111. The eccentric member 12 can be driven by the driving member 13 to drive the support member 111 and the polishing portion 112 to reciprocate in the one-dimensional direction. It is to be understood, a bearing can be sleeved on an outer side of the eccentric member 12 according to needs.

The driving member 13 includes a main body 131 and a rotating shaft 132.

The rotating shaft 132 is arranged in the main body 131. The rotating shaft 132 and the main body 131 together form a rotating pair. The eccentric member 12 is arranged on the rotating shaft 132 and is deviated from a central axis of the rotating shaft 132. The polishing mechanism 10 further includes a counterweight 14. The counterweight 14 is arranged on a side of the rotating shaft 132 and is configured to counterbalance the eccentric force of the eccentric member 12 during the rotation.

In one embodiment, the driving member 13 is a pneumatic motor. A pneumatic polisher (also known as a wind polisher) is generally used to polish metal such as stainless steel or aluminum and a wet polishing method is often used for polishing. The factors that affect the polishing efficiency of the wind polisher include a rotating speed. Due to the problem of vibration, the removal amount of the wind polisher in polishing is 0.1 mm. However, the removal amount of the polishing mechanism of the embodiment in polishing can be accurate to 0.006 mm to 0.007 mm. The factors that affect the polishing efficiency of the polishing mechanism of the embodiment do not include the rotating speed, thus the requirements for the driving element can be reduced, to reduce the cost.

A displacement and a moving speed of the polishing portion 112 in the one-dimensional direction can be calculated as needed, so as to accurately polish the workpiece 200. In one embodiment, the displacement of the polishing portion 112 satisfies the formula $S=a*\cos(\pi n/30)*t$, the moving speed of the polishing portion 112 satisfies the formula $V=-(a\pi n/30)*\sin(\pi n/30)*t$, wherein a is a distance between the central axis of the eccentric member 12 and the central axis of the rotating shaft 132 (that is, a is an offset of the eccentric member 12 in the one-dimensional direction), in millimeters; n is a rotation speed of the driving member 13, in revolutions/minute; t is a time, in seconds.

In one embodiment, the polishing mechanism 10 further includes a fixing member 15, the fixing member 15 is coupled to the polishing member 11.

The fixing member 15 is substantially rectangular plate. The fixing member 15 includes a through hole 151 penetrating through opposite sides of it. The eccentric member 12 is inserted in the through hole 151 and is configured to drive the fixing member 15 and the polishing member 11 to move in the one-dimensional direction. The fixing member 15 constrains the eccentric member 12 to reduce an error of the polishing member 11 caused by the vibration of the eccentric member 12.

When in use, the driving member 13 drives the eccentric member 12 to rotate. Since the eccentric member 12 is deviated from the central axis of the rotating shaft 132, the eccentric member 12 drives the fixing member 15 and the polishing member 11 to reciprocate in the one-dimensional direction to polish the workpiece 200 when the eccentric member 12 rotates.

In one embodiment, the polishing mechanism 10 further includes a sliding block 16 and a sliding rail 17.

The sliding block 16 is arranged on the main body 131 of the driving member 13.

The sliding rail 17 is arranged on the polishing member 11 and extends along the one-dimensional direction (the X axis). The polishing member 11 and the sliding block 16 together form a moving pair through the slide rail 17, so that the eccentric member 12 drives the polishing member 11 to reciprocate in the one-dimensional direction, the moving pair constraints the polishing member 11, thus avoiding any displacement of the polishing member 11 in the Y-axis direction which might affect the polishing accuracy.

Figure 4:
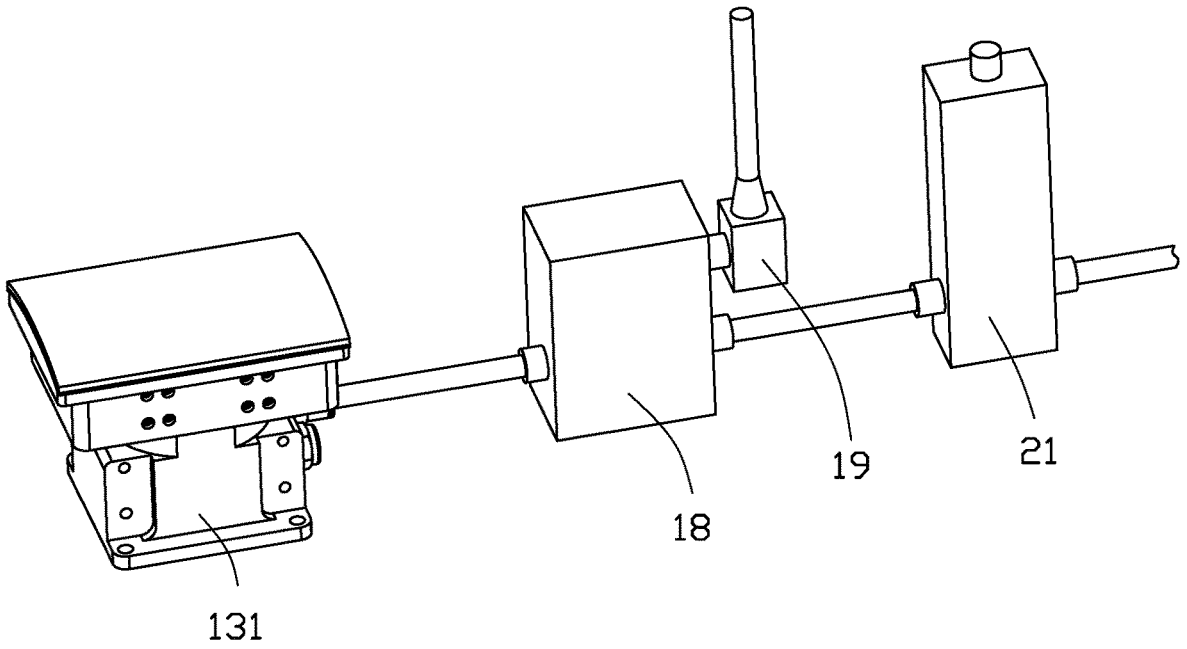
FIG. 4 illustrates a diagrammatic view of an embodiment of a polishing mechanism, a flow sensor, and a communicator.

In one embodiment, referring to FIG. 4, the polishing mechanism 10 further includes a flow sensor 18, a communicator 19, and a processor 21.

The flow sensor 18 is configured to sense a flow information of a medium passing into the main body 131. The medium includes but is not limited to gas and liquid, such as air and hydraulic oil.

The communicator 19 is coupled to the flow sensor 18 and is configured to receive the flow information sent by the flow sensor 18. The communicator 19 has an interface, which is configured to be a USB port, a UART port, and/or a Firewire port. Other devices (for example, the flow sensor 18 and the processor 21) can communicate with the interface.

The processor 21 is coupled to the communicator 19 and is configured for determining a working status of the polishing mechanism 10 according to the flow information. The working status includes whether the driving member is operating normally and whether the polishing portion 112 of the polishing member 11 needs to be replaced. In the embodiment, the processor 21 includes, but is not limited to, a central processing unit (CPU), a digital signal processor, or a single-chip microcomputer.

When in use, the real-time data of the rotating speed of the driving member 13 and the flow information of the medium can be collected by the processor 21 through the flow sensor 18. A real-time operating status of the polishing mechanism 10 can be obtained with big data analysis of all the data of the polishing mechanism 10, so that a working life of the polishing mechanism 10 can be predicted in advance, and a warning can be issued before the polishing mechanism 10 is damaged. At the same time, it is possible to remotely control the flow information of the medium passing with the polishing mechanism 10 according to the actual production through a network, so as to realize remote control of the polishing mechanism 10. At the same time, according to the aforementioned formulas for calculating the displacement and moving speed of the polishing portion 112, the number of polishing operations of the polishing portion 112 can be measured through the flow sensor 18, so that the replacement time of the polishing portion 112 can be preset (similar to the concept of calculating the maintenance time based on the number of kilometers driven by cars). For example, the polishing portion 112 can be a sandpaper with 3500 meshes. First, the number of polishing operations is calculated by the flow sensor 18 (when the polishing member 11 drives the polishing portion 112 to move the maximum displacement in a single direction, this is recorded as one time), and then the condition for replacing the sandpaper based on historical observation data is obtained (exemplary maximum number of polishing operations is 3000). When the number of polishing operations received by the processor 21 is more than a predetermined value (such as 2500 times), the processor 21 issues an alarm to notify a manager to check the sandpaper on site, to determine whether it needs to be replaced and how long before it should be replaced. After the condition for replacing the sandpaper is reached, the polishing mechanism 10 will automatically stop, improving the yield of the finished product.

In one embodiment, referring to FIG. 3, the polishing mechanism 10 further includes a vibration sensor 22.

The vibration sensor 22 is arranged on the driving member 13 and is configured for sensing vibration information of the driving member 13. The communicator 19 is coupled to the vibration sensor 22 and is configured for receiving the vibration information sent by the vibration sensor 22. The processor 21 is coupled to the communicator 19 and is configured for determining a working state of the polishing mechanism 10 according to the vibration information.

When in use, the vibration information of the driving part 13 can be monitored in real time through the vibration sensor 22, and the analysis data can be recorded and the impact of vibration on the polishing quality can be evaluated by the communicator 19. Based on this, the relevant structure and parameters can be further optimized to improve the polishing quality. Through the analysis of the amount of vibration, it can be determined whether the polishing mechanism 10 is in a normal working state. When the processor 21 determines that the vibration is abnormal, an alarm is issued to prompt manual maintenance or replacement.

Figure 5:
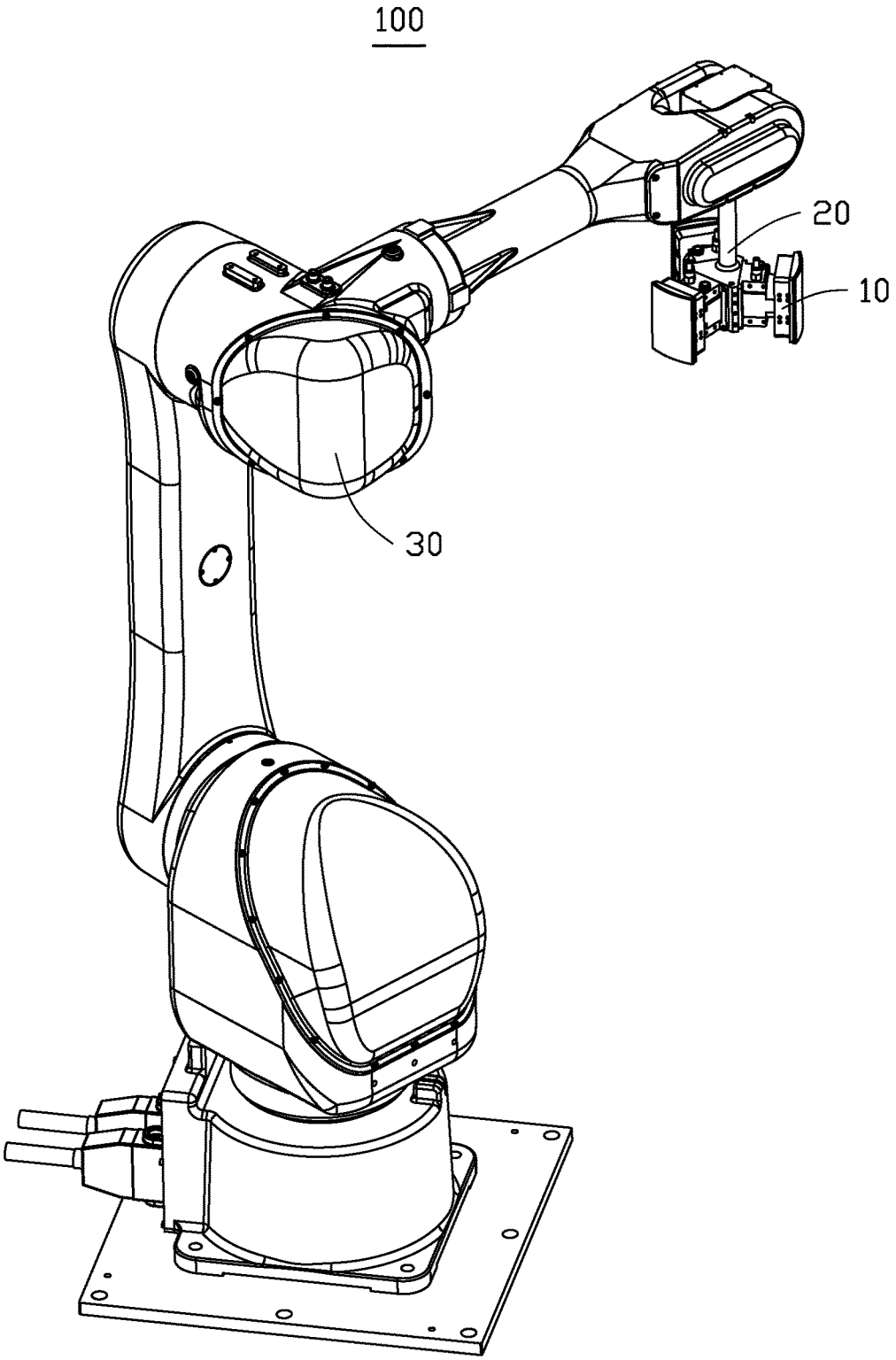
FIG. 5 illustrates an isometric view of an embodiment of a polishing device.

FIG. 5 illustrates an embodiment of a polishing device 100 which includes a plurality of the above polishing mechanisms 10, a connecting member 20, and a moving member 30.

The plurality of polishing mechanisms 10 are arranged on an outer peripheral surface of the connecting member 20 at intervals. The moving member 30 is coupled to the connecting member 20 and is configured to drive the connecting member 20 and the polishing mechanisms 10 to reciprocate in the one-dimensional direction, so that at least one of the polishing mechanisms 10 polishes the workpiece 200.

In one embodiment, the connecting member 20 is substantially triangular in shape. The connecting member 20 is provided with a connecting column, and the connecting column is fixed to the moving member 30 through a flange.

In one embodiment, the moving member 30 is a manipulator or a mechanical arm.

Figure 6:
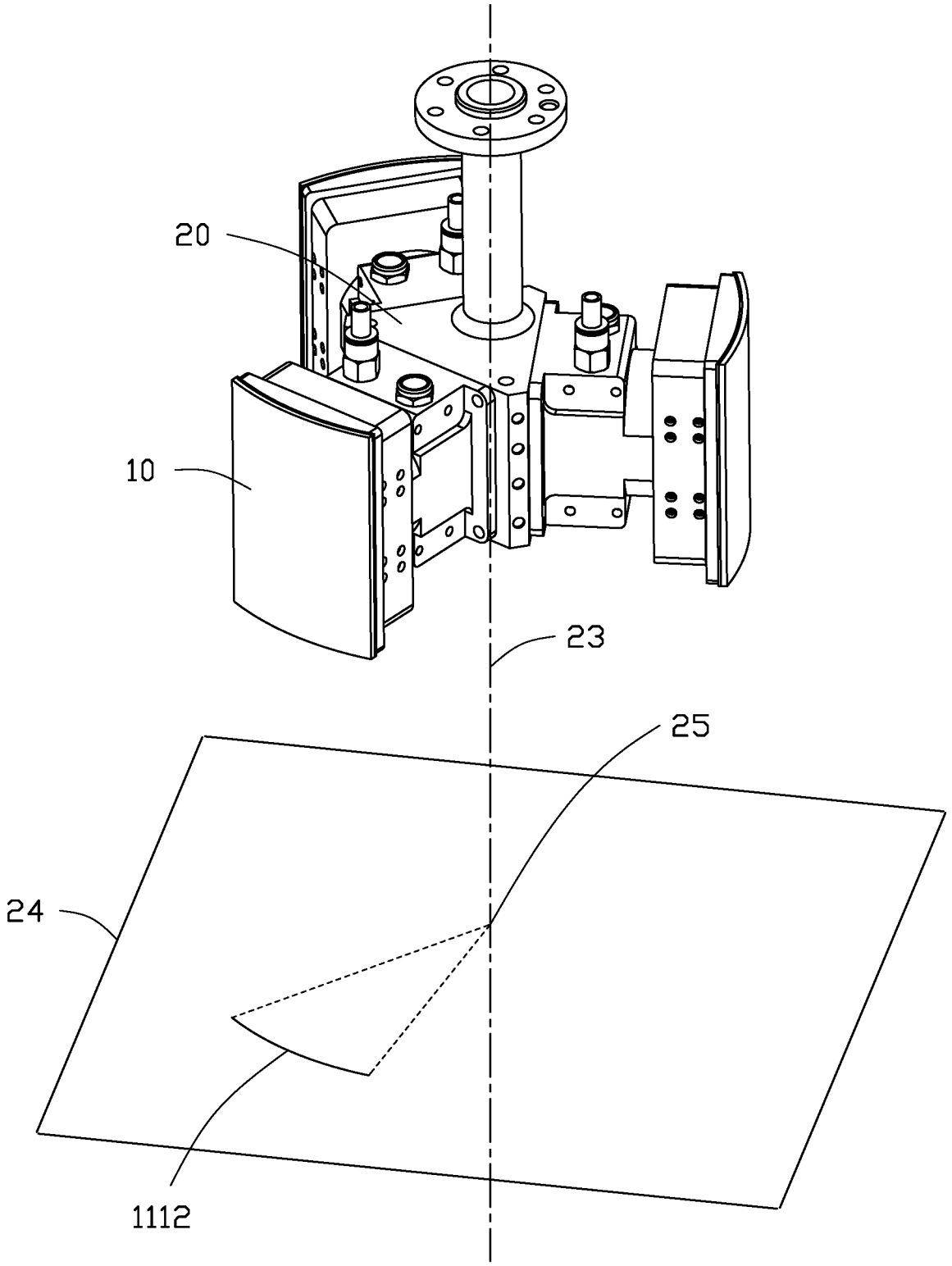
FIG. 6 illustrates a diagrammatic view of projections of an embodiment of a connecting member and a polishing mechanism of a polishing device.

In one embodiment, referring to FIG. 6, a projection plane 24 perpendicular to a central axis 23 of the connecting member 20 is defined. An intersection point 25 is formed by projection of the central axis 23 of the connecting member 20 on the projection plane 24, a curve line 1112 is formed by projection of the arc surface 1111 of the support member 111 on the projection plane 24, and a center of an osculating circle of the curve line 1112 is overlapped with the intersection point 25. The osculating circle is also called a curvature circle. On a normal line of a point M on the curve line 1112, a point D is taken on the concave side of the curve line 1112, wherein a length of the line DM is equal to the radius of curvature at the point D. A circle is made, with D as the center and DM as the radius. This circle is called the curvature circle whose curve is at the point. In this way, it is easy to calculate and make adjustments when the polishing mechanism 10 is offset, and a speed of applying adjustments is improved.

Figure 7:
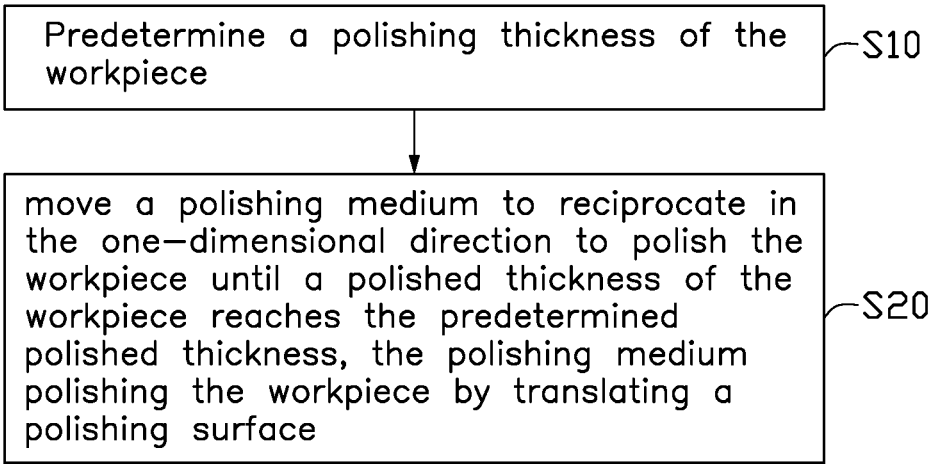
FIG. 7 illustrates a flowchart of an embodiment of a polishing method.

Referring to FIG. 7, a flowchart of a polishing method is presented in accordance with an embodiment which is being thus illustrated. The polishing method described below can be carried out using the configurations illustrated in FIGS. 2-6, for example, and various elements of these figures are referenced in explaining example method. The exemplary polishing method can begin at block S10.

At block S10, a polished thickness of the workpiece 200 is predetermined.

Before the polishing operation, the polished thickness of the workpiece 200 must be predetermined according to needs.

At block S20, a polishing medium is moved to reciprocate in the one-dimensional direction to polish the workpiece 200 until a polished thickness of the workpiece 200 reaches the predetermined polished thickness, the polishing medium polishing the workpiece 200 by translating a polishing surface.

The polishing medium may be products made of abrasive materials, such as sandpaper, grinding wheels, or the like.

Figure 8:
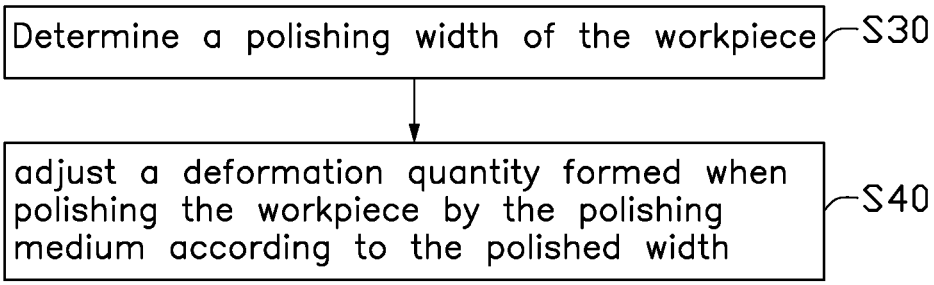
FIG. 8 illustrates a flowchart of an embodiment of a polishing method before determining a thickness of a workpiece to be polished.

FIG. 8 illustrates a flowchart of steps of the polishing method before determining a polished thickness of the workpiece 200.

At block S30, a polished width of the workpiece 200 is determined.

At block S40, a deformation quantity formed when polishing the workpiece 200 by the polishing medium is adjusted according to the polished width.

In order to avoid the problem of collapsed edge of the workpiece 200 during polishing, the deformation quantity formed when polishing the workpiece 200 by the polishing medium can be adjusted according to the polished width, so that a polished width of the polishing medium in the one-dimensional direction is smaller than a width of the polishable surface of the workpiece 200. Therefore, the polishing medium can accurately polish the workpiece 200.

Figure 9:
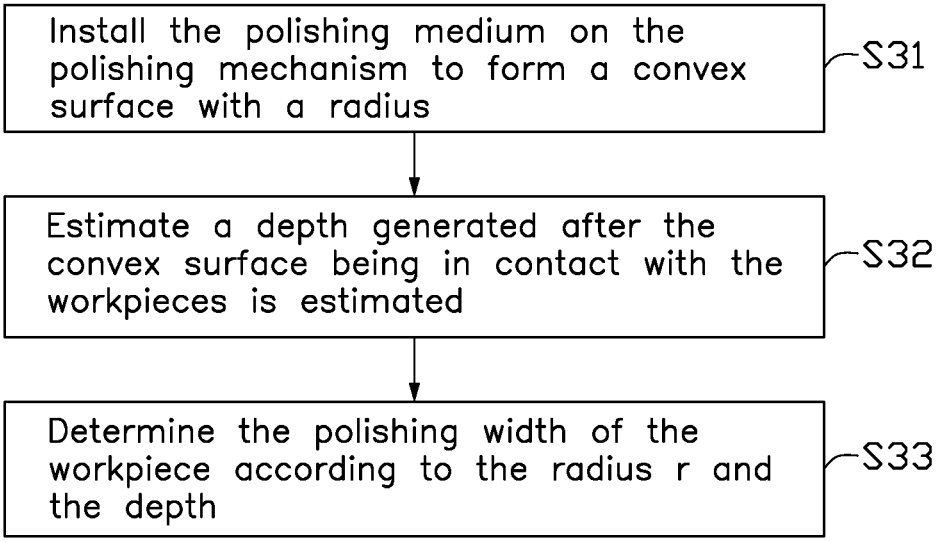
FIG. 9 illustrates a flowchart of an embodiment of a method for determining a polished width of a workpiece.

FIG. 9 illustrates a flowchart of a method for determining a polished width of the workpiece 200.

At block S31, the polishing medium is installed on the polishing mechanism 10 to form a convex surface with a radius r.

The polishing medium acts as the polishing portion 112 of the polishing mechanism 10. The polishing mechanism 10 includes the support member 111 with the arc surface 1111. In one embodiment, the polishing portion 112 is a sandpaper, when the sandpaper is attached to the arc surface 1111 with Velcro, an arc-shaped convex surface with a radius r is formed. In other words, the convex surface is projected on the projection plane 24 to form the curve line 1112, the radius r is the radius of the osculating circle of the curve line 1112.

At block S32, a depth generated after the convex surface being in contact with the workpiece is estimated.

The convex surface is an arc surface, the contact between the polishing medium and the workpiece 200 during the polishing process is the contact between the arc surface and the plane surface. After being polished, a polishable surface 210 (shown in FIG. 10) of the workpiece 200 is an arc surface. The depth is the maximum depth of the polishing medium for polishing, which is labeled as c in FIG. 10.

Figure 10:
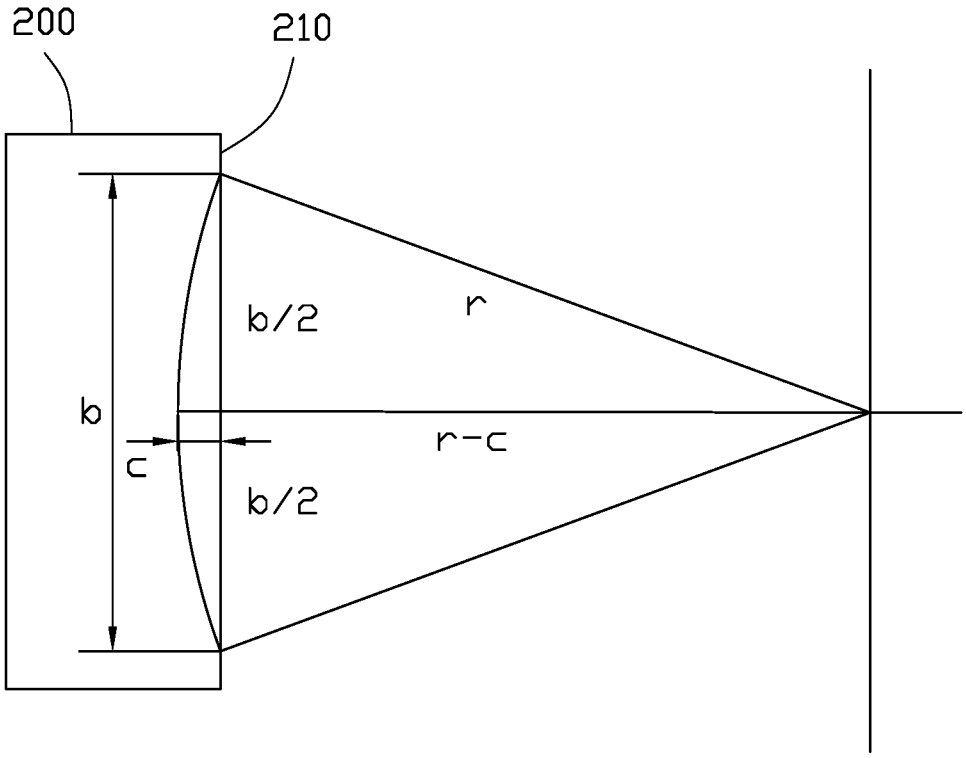
FIG. 10 illustrates a schematic diagram of an embodiment of a method for determining a polished width of a workpiece.

At block S33, referring to FIG. 10, the polished width of the workpiece 200 is determined according to the radius r and the depth c.

The polished width of the workpiece 200 satisfies the formula $b=2\sqrt{2cr-c^2}$, wherein b is the polished width of the workpiece 200, c is the depth of the polishing medium for polishing, and r is the radius of the convex surface.

In the polishing mechanism 10, the driving member 13 drives the eccentric member 12 to rotate to drive the polishing member 11 to reciprocate in the one-dimensional direction, so that the polishing member 11 polishes the workpiece 200 by translating a polishing surface. In the polishing device 100, the moving member 30 drives the connecting member 20 and the polishing mechanism 10 to reciprocate in the one-dimensional direction, so that at least one polishing mechanism 10 can polish the workpiece. In the polishing method, the polishing medium reciprocates in the one-dimensional direction, so that the polishing medium polishes the workpiece 200 by translating a polishing surface. Compared with the relevant art, by using the polishing mechanism 10, the polishing device 100, and the polishing method of the present application, the surface of the workpiece 200 polished is relatively complete, the polishing quality is high, and the collapsed edge of the workpiece 200 in the polishing process is avoided.

While the present disclosure has been described with reference to particular embodiments, the description is illustrative of the disclosure and is not to be construed as limiting the disclosure. Therefore, those of ordinary skill in the art can make various modifications to the embodiments without departing from the scope of the disclosure as defined by the appended claims.

What is claimed is:

1. A polishing mechanism comprising:

a polishing member comprising a support member and a polishing portion configured to polish a workpiece, wherein the support member comprises an arc surface, the polishing portion is arranged on the arc surface, a polishing width of polishing portion in a one-dimensional direction is smaller than a width of a polishable surface of the workpiece;

an eccentric member coupled to the support member of the polishing member; and a driving member coupled to the eccentric member, wherein the driving member is configured to drive the eccentric member to rotate to drive the polishing member to reciprocate in the one-dimensional direction, and when a position of the polishing mechanism relative to the workpiece is fixed, an arc-shaped convex surface of the polishing portion of the polishing member polishes the workpiece by translating a polishing surface.

2. The polishing mechanism according to claim 1, wherein the polishing mechanism further comprises:

a fixing member coupled to the polishing member and comprising a through hole penetrating through opposite sides of the fixing member, wherein the eccentric member is inserted in the through hole to drive the fixing member and the polishing member to reciprocate in the one-dimensional direction.

3. The polishing mechanism according to claim 1, wherein the polishing mechanism further comprises:

a sliding block arranged on the driving member;

a sliding rail arranged on the polishing member and extending along the one-dimensional direction, wherein the polishing member and the sliding block together form a moving pair through the slide rail.

4. The polishing mechanism according to claim 3, wherein the driving member comprises a main body and a rotating shaft arranged in the main body, the rotating shaft and the main body together form a rotating pair, the sliding block is arranged on the main body, the eccentric member is arranged on the rotating shaft and deviated from a central axis of the rotating shaft.

5. The polishing mechanism according to claim 1, wherein the polishing mechanism further comprises:

a flow sensor;

a communicator coupled to the flow sensor and configured to receive flow information sent by the flow sensor;

a processor coupled to the communicator and configured to determine a working state of the polishing mechanism according to the flow information.

6. The polishing mechanism according to claim 1, wherein the eccentric member is coupled to the support member and configured to drive the support member and the polishing portion to reciprocate in the one-dimensional direction.

7. The polishing mechanism according to claim 1, wherein the polishing mechanism further comprises:

a vibration sensor arranged on the driving member and configured to sense vibration information of the driving member;

a communicator coupled to the vibration sensor and configured for receiving the vibration information sent by the vibration sensor;

a processor coupled to the communicator and configured for determining a working state of the polishing mechanism according to the vibration information and issuing an alarm command.

8. A polishing device comprising:

a plurality of polishing mechanisms, each of the plurality of polishing mechanisms comprising:

a polishing member comprising a support member and a polishing portion configured to polish a workpiece, wherein the support member comprises an arc surface, the polishing portion is arranged on the arc surface, a polishing width of polishing portion in a one-dimensional direction is smaller than a width of a polishable surface of the workpiece, an eccentric member coupled to the support member of the polishing member, and a driving member coupled to the eccentric member;

a connecting member, the plurality of polishing mechanisms being arranged on an outer peripheral surface of the connecting member at intervals; and a moving member coupled to the connecting member;

wherein the driving member is configured to drive the eccentric member to rotate to drive the polishing member to reciprocate in the one-dimensional direction, and when a position of the polishing mechanism relative to the workpiece is fixed, an arc-shaped convex surface of the polishing portion of the polishing member polishes the workpiece by translating a polishing surface;

wherein the moving member is configured to drive the connecting member and the plurality of polishing mechanisms to reciprocate in the one-dimensional direction, so that at least one of the plurality of polishing mechanisms polishes the workpiece.

9. The polishing device according to claim 8, wherein the polishing portion is installed on an end of the support member, and the connecting member is coupled to the other end of the support member;

wherein a projection plane perpendicular to a central axis of the connecting member is defined, an intersection point is formed by projection of the central axis of the connecting member on the projection plane, a curve line is formed by projection of the arc surface of the support member on the projection plane, and a center of an osculating circle of the curve line is overlapped with the intersection point.

10. The polishing device according to claim 8, wherein each of the plurality of polishing mechanisms further comprises a fixing member coupled to the polishing member and comprising a through hole penetrating through opposite sides of the fixing member, the eccentric member is inserted in the through hole to drive the fixing member and the polishing member to reciprocate in the one-dimensional direction.

11. The polishing device according to claim 8, wherein each of the plurality of polishing mechanisms further comprises:

a sliding block arranged on the driving member;

a sliding rail arranged on the polishing member and extending along the one-dimensional direction, wherein the polishing member and the sliding block together form a moving pair through the slide rail.

12. The polishing device according to claim 11, wherein the driving member comprises a main body and a rotating shaft arranged in the main body, the rotating shaft and the main body together form a rotating pair, the sliding block is arranged on the main body, the eccentric member is arranged on the rotating shaft and deviated from a central axis of the rotating shaft.

13. The polishing device according to claim 8, wherein each of the plurality of polishing mechanisms further comprises:

a flow sensor;

a communicator coupled to the flow sensor and configured to receive a flow information sent by the flow sensor;

a processor coupled to the communicator and configured to determine a working state of the polishing mechanism according to the flow information.

14. The polishing device according to claim 8, wherein the eccentric member is coupled to the support member and configured to drive the support member and the polishing portion to reciprocate in the one-dimensional direction.

15. The polishing mechanism according to claim 8, wherein each of the plurality of polishing mechanisms further comprises:

a vibration sensor arranged on the driving member and configured to sense a vibration information of the driving member;

a communicator coupled to the vibration sensor and configured for receiving the vibration information sent by the vibration sensor;

a processor coupled to the communicator and configured for determining a working state of the polishing mechanism according to the vibration information and issuing an alarm command.

16. A polishing method comprising:

predetermining a polished thickness of a workpiece;

moving a polishing medium to reciprocate in a one-dimensional direction to polish the workpiece until a polished thickness of the workpiece reaches the predetermined polished thickness, the polishing medium polishing the workpiece by translating a polishing surface, the polishing surface of the polishing medium being an arc-shaped convex surface, a polishing width of the polishing medium in the one-dimensional direction being smaller than a width of a polishable surface of the workpiece.

17. The polishing method according to claim 16, further comprising:

determining a polished width of the workpiece;

adjusting a deformation quantity formed by polishing the workpiece with the polishing medium according to the polished width.

18. The polishing method according to claim 17, wherein determining a polished width of the workpiece comprises:

installing the polishing medium on a polishing mechanism to form a convex surface with a radius;

estimating a depth generated after the convex surface being in contact with the workpiece;

determining the polished width of the workpiece according to the radius and the depth.

* * * * *